US006578531B1

(12) United States Patent
Cacace

(10) Patent No.: US 6,578,531 B1
(45) **Date of Patent: *Jun. 17, 2003**

(54) GAS APPLIANCE WITH FLASH SUPPRESSOR

(76) Inventor: Jeffrey Cacace, 332 Franklin Ave., Franklin Square, NY (US) 11010

( * ) Notice: Subject to any disclaimer, the term of this patent is extended or adjusted under 35 U.S.C. 154(b) by 0 days.

This patent is subject to a terminal disclaimer.

(21) Appl. No.: 10/105,561

(22) Filed: Mar. 21, 2002

(51) Int. Cl.[7] ..... F24H 9/02

(52) U.S. Cl. ..... 122/19.2; 122/494; 122/504; 122/44.2; 122/155.2

(58) Field of Search ..... 122/13.01, 19.2, 122/494, 504, 44.2, 155.2

(56) References Cited

U.S. PATENT DOCUMENTS 5,823,175 A * 10/1998 Sweitzer et al. ..... 122/20 A
5,848,586 A * 12/1998 Garms ..... 122/11
5,918,591 A 7/1999 Vollmar et al.
5,967,138 A 10/1999 Cacace
6,290,490 B1 9/2001 Cacace
6,309,209 B1 10/2001 Cacace

* cited by examiner

*Primary Examiner*—Jiping Lu
(74) *Attorney, Agent, or Firm*—Collard & Roe, P.C.

(57) ABSTRACT

A water heater having a barrier for forming an enclosure around a lower portion of heater. The barrier has an inside wall, an outside wall and a space between the inside and outside walls. There is a skirt disposed within the barrier for slidably receiving the water heater tank. The burner for the water heater is disposed within the skirt. The outside wall of the barrier has at least one aperture for air to pass into the space. The inside wall has a plurality of ventilation holes to allow heat currents to escape through the space and causes a siphoning effect, thus preventing any fumes from reaching the flame. There is an outwardly extending flange surrounding a top edge of the barrier. The flange has an inside wall connected to the inside wall of the barrier, an outside wall connected to the outside wall of the barrier, and a space between the inside and outside walls that communicates with the space in the barrier. The flange has an open top, so that fumes travel through the filter and out the open top and are thus kept away from the flame in the appliance.

16 Claims, 3 Drawing Sheets

GAS APPLIANCE WITH FLASH SUPPRESSOR

BACKGROUND OF THE INVENTION

1. Field of the Invention

This invention relates to a natural gas appliance such as a water heater having a protective device built into the lower periphery of the unit, to prevent vapors from spills of flammable liquids from contacting the ignition source of the appliance.

2. The Prior Art

There are more than 50 million homes in the United states that heat their domestic water with conventional gas fired water heaters. Although these units are very efficient and cost effective, there is an opportunity to improve on the design to completely eliminate a potential source of infernos and explosions in the event of an accidental flammable liquid spill in the vicinity of the water heater.

The extent of this devastation is alarming. There are over two thousand such accidents each year in this country, causing hundreds of personal injuries and dozens of fatalities. Most of the deaths are young children who are innocently unaware of the danger. In addition, there are tens of millions of dollars in property damage each year, with hundreds of the victims sustaining total losses. Combined, there is a total societal cost topping half a billion dollars per year due to the current design.

There have been attempts to construct shields to keep the vapors from spills from coming near the flames of the water heater. One such device is disclosed in U.S. Pat. No. 5,918,591 to Vollmar et al. This device comprises a mounting strip and a shield mounted in the mounting strip to surround the water heater. The strip and shield are made of plastic. Another such device is shown in U.S. Pat. No. 5,967,138 to Cacace. This device comprises an aluminum collar that is held in place by two rings to hold it in place. A further design is shown in U.S. Pat. Nos. 6,290,490 and 6,309,209 to Cacace, the disclosures of which are herein incorporated by reference, which also disclose a flash suppressor applied to existing appliances that prevents vapors from coming near the flames of the appliance.

SUMMARY OF THE INVENTION

It is therefore an object of the present invention to overcome the drawbacks of the prior art and to provide a water heater having a built-in means for preventing explosions and fires resulting from the contact of all fumes of flammable liquids with the gas flames in the heater.

These and other objects and features of the present invention are accomplished by a water heater having a flash suppressor which comprises a barrier that forms an enclosure around a lower portion of the heater. The heater comprises a water tank and a steel skirt having a bottom and a side wall for slidably receiving the skirt. The skirt is approximately fourteen inches high and has apertures for allowing air to enter the combustion chamber. The apertures are preferably 1/16 perforated holes that allow air to enter but not exit from the combustion chamber. There is a flue and baffle in the center of the water heater that rests on the combustion chamber. There is a burner affixed to the bottom of the skirt for heating water in the water tank. Gas is fed to the burner assembly, which in turn heats the water in the tank. A thermostat controls this process. In use, the tank is slid into the skirt so that it rests on top of the burner.

The barrier is attached to and surrounds the skirt and has an inside wall, an outside wall and a space between the inside and outside walls. The outside wall has at least one aperture for air to pass into the space. The aperture is preferably located in the bottom portion of the outside wall. The outside wall is preferably 11¾ inches high. The inside wall is preferably located approximately ¼ inch away from the outside wall and 1 inch away from the skirt wall. The inside wall is preferably approximately 12 inches high. Vapors enter the space between the inside and outside walls through the aperture in the outside wall and are then pulled through this space and exit out of the top.

The inside wall has a plurality of ventilation "vortex" holes disposed in three rows located approximately two inches from the top to allow the heat currents to enter the space. The top row of holes are one sixteenth of an inch triangular perforations one inch apart. The center row of holes start one inch below the top row and are one sixteenth of an inch triangular perforations spaced ½ inch apart. The final row of holes begin one inch below the center row and are one sixteenth of an inch triangular perforations spaced one inch apart and are staggered from the top row. All perforated holes face the outside wall. This process draws air in the outer aperture by way of air currents created by the energy the appliance gives off The currents enter the "vortex" through the fresh air intake and cause a siphoning effect to the inside and outside walls. The inside and outside walls create a spout on top that extends away from the appliance at a 45 degree angle. The spout is at least one inch in length and is an extension of the inside and outside walls.

The entire device is preferably constructed of thin-gauged rolled steel and the inside wall is preferably made of aluminum. This allows the inside wall to heat up warmer than the outer walls to help the air currents rise. This process has proven to be extremely effective during tests.

There is a filter disposed in the space between the lower inside and lower outside walls or in the aperture of the outside wall to help break down the fumes while they are channeled through the flash suppressor. The filter can be made up of activated carbon. The activated granules attract the hydrocarbons in the vapors as they pass through the filter. These filters must be changed after every accident as they "fill up" with flammable hydrocarbons.

Alternatively, the filter can be a screen made of a FeCrAlloy® material, which is an iron/chromium alloy, that is coated with a hydrocarbon-based catalyst. This catalyst will "burn" off hydrocarbons and render them harmless. The catalyst must be heated to become active. This is accomplished by a plurality of heat radiating rods extending radially from the burner to the side wall of the skirt. The rods are made of stainless steel alloy and help to equalize the heat within the combustion chamber so that noxious gases. from the burner are burned off. The rods are covered with a ceramic sleeve for insulation. The rods are attached to the screen. The combustion chamber heats the rods, which in turn heat the screen to become active. This process works well as long as the burner is on and not in an idled position. The rods are also preferably coated with a catalyst for best results.

A third alternative for a filter is a screen formed from a material comprised of "Sol-gel" which is an organic polymer sorbent that has affinities for wider variety of analytes than does the carbon based sorbents. Organic polymer sorbents usually have lower thermal stability limits. The Sol-gel is formed into a screen to fit the aperture in the outer wall and acts a s a filter to remove the harmful hydrocarbons. The Sol-gel does not need to be cleaned, refreshed or changed.

The space between the skirt and the inside wall is about 1 inch, and the space between the inside walls and the outside walls of the upper portion, and between the filter and inside wall is preferably about ½ inch, which allows sufficient air flow through the barrier without it being too thick or too thin to cause the air draft to be too strong or too weak. If the draft is too strong, the filter may not work efficiently. If the draft is too weak, the current cannot draw the fumes fast enough to work properly.

To maintain the width of the spaces, there are a plurality of vertical ribs disposed between the inside and outside walls. Alternatively, other types of spacers or supports could also be used.

By having a controlled vertical process and a reverse vertical process in the same channel, we are creating a reciprocating movement throughout the channel. This movement causes a centrifical motion within the channel, or a vortex ring. This vortex ring remains perpetual as long as the vertical and reverse vertical processes remain perpetual. The air currents that flow through this part of the flash suppressor™ makes flash suppressor™ a non-moving centrifuge. It acts as an air channeling tool that creates a swirling air motion that, by design, separates gases of different densities. When any errant vapors enter the channel, they become picked up by the vortex ring. The continuous swirling, mixing with a constant flow of fresh air and heated air, cause the vapors to dilute at a faster rate than they would if left in an idled state. These now diluted vapors become lighter when mixed with air and are released into the vertical process. One can also theorize, that, as the vapors are being held by the vortex ring, the transmitting energy or heat begins to decompose the molecules of the hydrocarbon. Liquid hydrocarbon has a very low boiling point, as gas hydrocarbon has a very low endothermic decomposition point. This process converts the hydrogen in the hydrocarbons to a steam or evaporation. The carbon in the hydrocarbons becomes a form of carborundum or ash. This now converted gas to a solid and a liquid is retained by the vortex ring and pulled to the center or the centrasome of the vortex because these materials are now of a lighter nature than the hydrocarbon gas. The centrasome now acts as a contracting vacuole and creates a temporary analpore that releases the particles into the vertical process. This atmospheric condition works like a single cell "animal". Any vapors that enter from beneath, i.e. leak, are picked up by the vortex ring as well. The entire process works on atmospheric currents that are created by an energy source. In this case the combustion chamber.

The burning of natural gas at the high temperatures needed for a water heater creates noxious fumes. These fumes are eliminated by the plurality of rods within the combustion chamber and by a screen surrounding the baffle within the water heater. The screen is made from FeCrAlloy® and coated with a group of platinum metal catalysts that pertain to nitrogen oxide and dioxide. The screen burns off the noxious fumes before they exit the water heater. This process is similar to the catalytic converter in an automobile exhaust system. This "No-Nox" system can be enhanced if needed by catalyzing the baffle as well.

The present invention is simple to manufacture and successfully prevents ignition of fumes that occur from flammable liquid spills near the water heater.

BRIEF DESCRIPTION OF THE DRAWINGS

Other objects and features of the present invention will become apparent from the following detailed description considered in connection with the following drawings. It is to be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
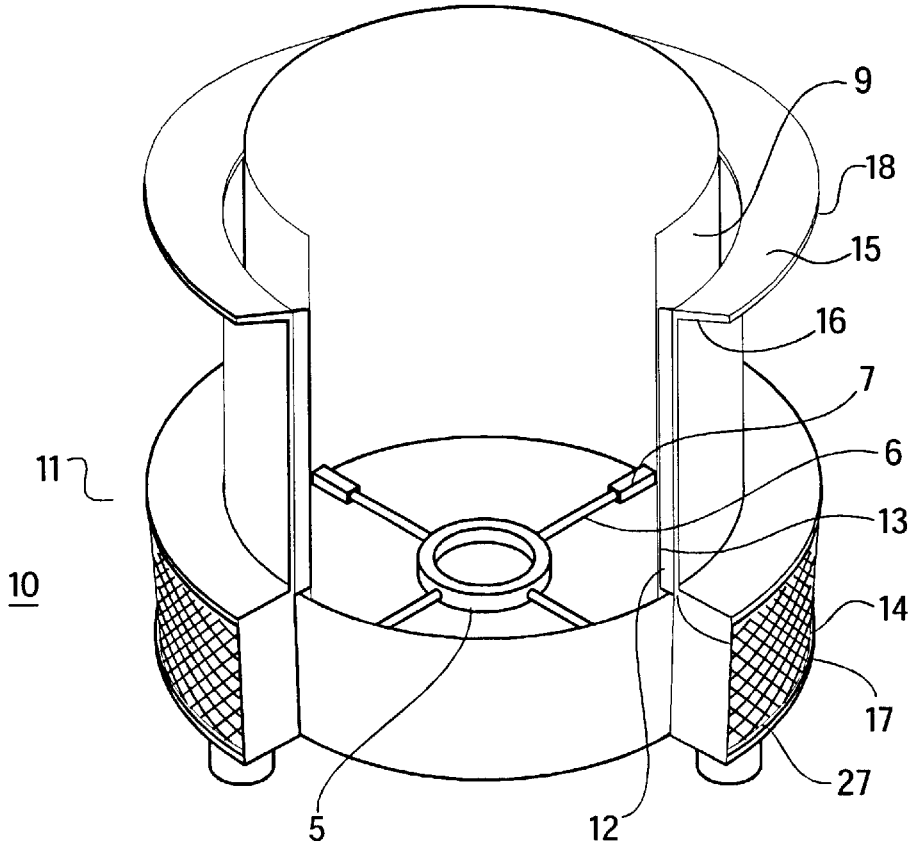
FIG. 1 is an exploded cross-sectional view of a section of the water heater according to the invention.
Figure 2:
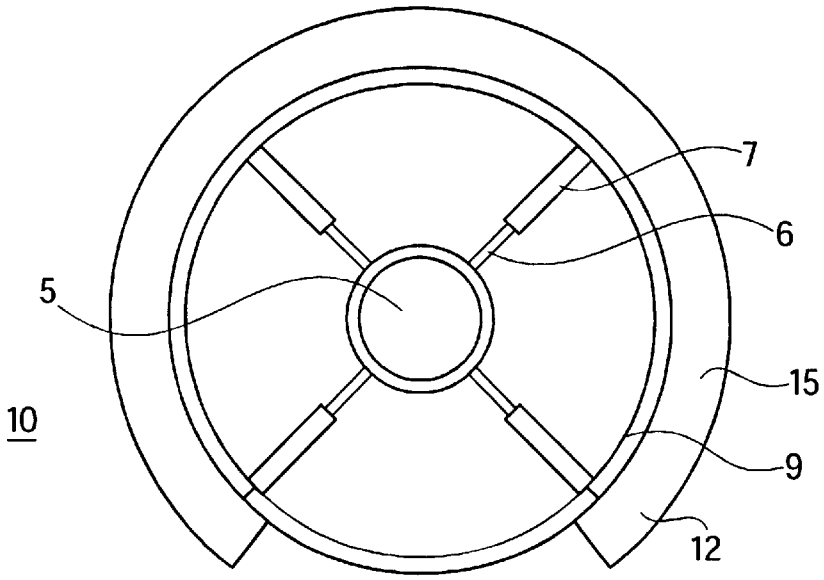
FIG. 2 is a perspective view of the combustion chamber.
Figure 3:
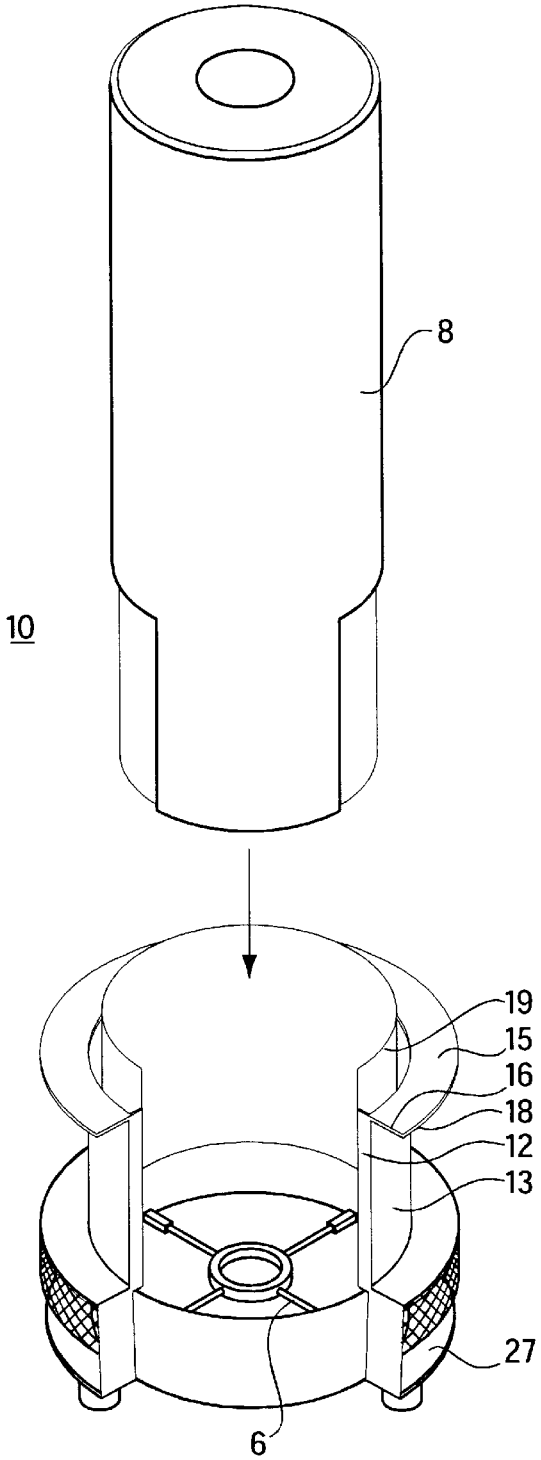
FIG. 3 is a top cross-sectional view along lines III—III of FIG. 1.
Figure 5:
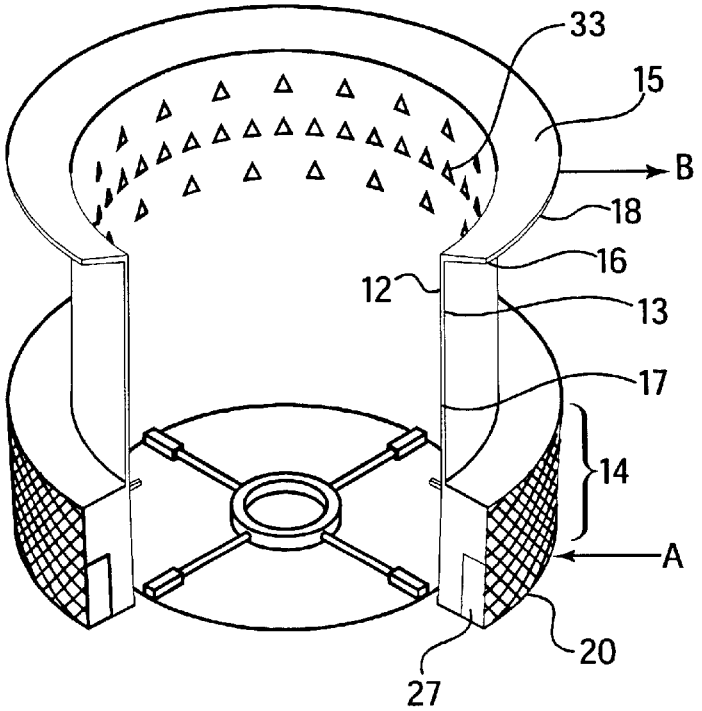
FIG. 5 is a partial view of the barrier.
Figure 6:
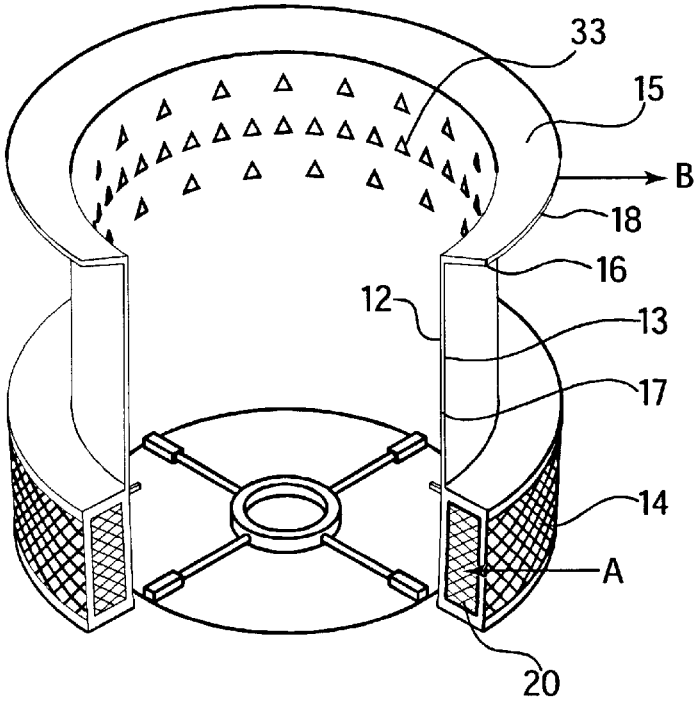
FIG. 6 is an alternative embodiment of the barrier.

Turning now in detail to the drawings, FIGS. 1 to 3 show a water heater 10 according to the invention. Water heater 10 comprises a barrier 11 having an aluminum inside wall 12 and a steel outside wall 13 having a wider lower portion 14. There is a space 17 between inside wall 12 and outside wall 13 to allow air to flow through. Inside wall 12 has a plurality of ventilation holes 33 (as shown in FIGS. 5 and 6) to allow the thermal currents to enter the space 17. There is a skirt 9 for surrounding the water heater tank 8 as it is slidably inserted in skirt 9.

Disposed within skirt 9 is a burner system 5 for heating the water in water heater 10. Extending from burner system 5 are a plurality of rods 6 surrounded by a ceramic casing 7. Rods 6 even the distribution of heat within water heater 10 to burn of noxious fumes created by burner 5.

There is a steel flange 15 extending upward and outward from barrier 11. Flange 15 has an interior space 16 that communicates with space 17. Flange 15 has an open edge 18 to allow air and gases in space 16 to escape. Flange 15 may be a separate piece that is welded onto barrier 11 or it may be integrally formed with barrier 11.

Figure 4:
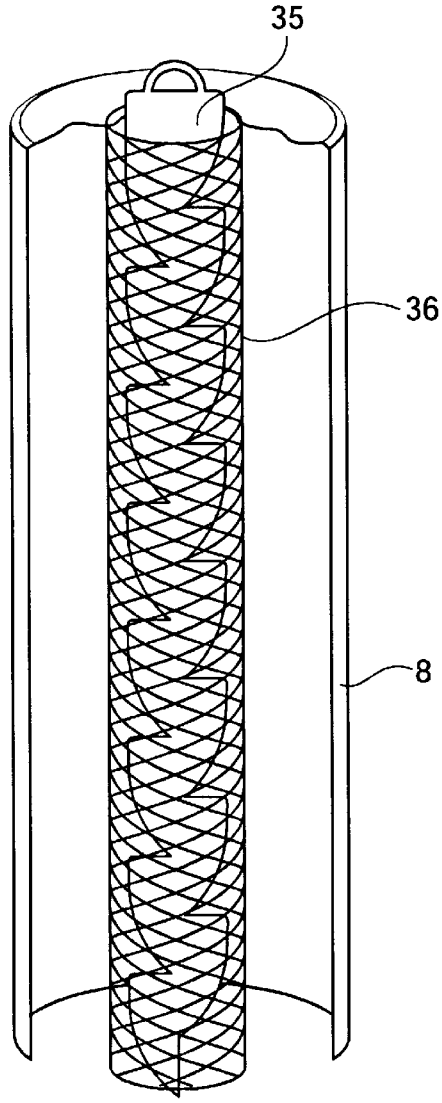
FIG. 4 is a view of the baffle and screen according to the invention.

FIG. 4 shows the inside of tank 8, which has a baffle 35 surrounded by a screen 36. The noxious fumes created by burner 5 are eliminated by screen 36. Screen 36 is made from FeCrAlloy® and coated with a group of platinum metal catalysts that pertain to nitrogen oxide and dioxide. Screen 36 burns off the noxious fumes before they exit the water heater 10. This process is similar to the catalytic converter in an automobile exhaust system.

As shown in FIGS. 5 and 6, a filter 20 is inserted in water heater 10 to filter out particulate matter that may be in the surrounding air. As shown in FIG. 5, filter 20 is a screen that is placed in aperture 27 of outer wall 13. Screen 20 is made of a FeCrAlloy® material, which is an iron/chromium alloy, that is coated with a hydrocarbon-based catalyst. This catalyst will "burn" off hydrocarbons and render them harmless. The catalyst must be heated to become active. This is accomplished by rods 6, which extend radially from burner 5 to skirt 9. Rods 6 are made of metal and help to equalize the heat within the water heater 10 so that noxious gases from the burner are burned off. Rods 6 are covered with a ceramic sleeve 7 for insulation. Rods 6 are attached to filter 20. Burner 5 heats the rods, which in turn heat the screen to become active. This process works well as long as the burner 5 is on and not in an idled position. The rods 6 are also preferably coated with a catalyst for best results.

Alternatively, filter 20 can be made from a material comprised of "Sol-gel" which is an organic polymer sorbent that has affinities for wider variety of analytes than does the carbon based sorbents. Organic polymer sorbents usually have lower thermal stability limits. The Sol-gel acts as a filter to remove the harmful hydrocarbons. The Sol-gel does not need to be cleaned, refreshed or changed.

FIG. 6 shows an alternative embodiment of filter 20. Here, filter 20 is an activated carbon filter that absorbs hydrocarbons and flammable liquids and is removably disposed in space 17 between inner wall 12 and lower portion 14. Filter 20 is removably installed in space 17 by sliding it in between lower portion 14 and inside wall 11 through channel 28 and covering it by a cap 19 which extends around a channel that separates lower portion 14 from upper portion 13. Filter 20 preferably contains activated carbon to filter out flammable hydrocarbons in the surrounding air.

So that fumes from the surrounding area can enter space 17 through filter 20, lower portion 14 has a large aperture 27. Gases and fumes from a spill or leak can pass through filter 20 via arrows A and enter spaces 17 and 16 and exit flange 15 through open edge 18 as shown by arrow B, at which point the fumes have been filtered and are harmless. The angle of flange 15 aims the fumes away from the appliance. The present invention keeps the fumes away from the flame in the combustion chamber. The thinner aluminum inside wall 12 becomes hotter than the thicker steel outside wall 13 and helps cause a thermal draft inside flash suppressor 10. This pulls air and fumes in from outside flash suppressor 10, to be filtered by filter 20. The filtered fumes are then sucked through flange 15 and out edge 18.

Barrier 11 is preferably constructed of galvanized steel, but other materials could be used as well.

Accordingly, while only a few embodiments of the present invention have been shown and described, it is obvious that many changes and modifications may be made thereunto without departing from the spirit and scope of the invention.

What is claimed is:

1. A water heater having an integral flash suppressor, comprising:

a water tank;

a skirt having a side wall and a bottom for slidably receiving said tank;

a burner affixed to the bottom of said skirt for heating water in said tank; and a barrier attached to and forming an enclosure around said skirt, said barrier having an inside wall, an outside wall and a space between said inside and outside walls, said outside wall having at least one aperture for air to pass into said space;

wherein fumes near said outside wall travel through said space and out of said barrier to prevent the fumes from reaching the burner.

2. The water heater according to claim 1, further comprising an upwardly and outwardly extending flange surrounding a top edge of said barrier, said flange having an inside wall connected to the inside wall of the barrier, an outside wall connected to the outside wall of the barrier, a space between said inside and outside walls that communicates with the space in the barrier, and an open top, wherein fumes travel through said filter and through said spaces and out said open top.

3. The water heater according to claim 1, further comprising a plurality of rods extending radially from the burner through the side wall of the skirt, said rods absorbing heat from the burner and allowing noxious gases from the burner to be burned off.

4. The water heater according to claim 3, wherein the rods are made of metal and are encased in ceramic sleeves.

5. The water heater according to claim 1, wherein the barrier is about twelve inches in height.

6. The water heater according to claim 1, wherein the barrier is made of thin-gauge rolled steel, except for the inside wall, said inside wall being made of aluminum.

7. The water heater according to claim 1, wherein the barrier is circular.

8. The water heater according to claim 1, further comprising a filter disposed in the space between the inside and outside walls for filtering particulate matter and hydrocarbons.

9. The water heater according to claim 8, wherein the filter comprises activated carbon.

10. The water heater according to claim 1, further comprising a filter comprising a screen disposed in the aperture in said outside wall for filtering particulate matter and hydrocarbons.

11. The water heater according to claim 10, wherein the filter is made with an iron/chromium alloy.

12. The water heater according to claim 11, wherein the filter is made of an organic polymer sorbent.

13. The water heater according to claim 10, wherein said screen is made of an iron/chromium alloy and also contains a platinum catalyst.

14. The water heater according to claim 1, further comprising a baffle inserted within the water heater tank, and further comprising a screen surrounding said baffle, said screen filtering noxious fumes created by said burner.

15. The water heater according to claim 1, further comprising plurality of ventilation holes disposed around said inside wall to allow heat currents to enter said space.

16. The water heater according to claim 15, wherein the ventilation holes are disposed in three horizontal rows and are each triangular in shape.

* * * * *